US011622609B2

(12) United States Patent
Hall

(10) Patent No.: US 11,622,609 B2
(45) Date of Patent: Apr. 11, 2023

(54) DOUBLE LOOP WRAPPING HAIR TIES

(71) Applicant: Jason Oaxaca Hall, South Jordan, UT (US)

(72) Inventor: Jason Oaxaca Hall, South Jordan, UT (US)

( * ) Notice: Subject to any disclaimer, the term of this patent is extended or adjusted under 35 U.S.C. 154(b) by 129 days.

(21) Appl. No.: 16/819,585

(22) Filed: Mar. 16, 2020

(65) Prior Publication Data

US 2020/0305571 A1 Oct. 1, 2020

Related U.S. Application Data

(60) Provisional application No. 62/823,058, filed on Mar. 25, 2019.

(51) Int. Cl.
*A45D 8/00* (2006.01)
*A45D 8/36* (2006.01)

(52) U.S. Cl.
CPC ..... *A45D 8/36* (2013.01)

(58) Field of Classification Search
CPC ..... A45D 8/34; A45D 8/36; Y10T 24/1402; Y10T 24/1404; Y10T 24/24; Y10T 24/21; Y10T 24/218; Y10T 24/4755; A44B 13/00; A44C 5/18; A44C 5/20; A44C 5/2019; A44C 5/0053
See application file for complete search history.

(56) References Cited

U.S. PATENT DOCUMENTS 607,604 A * 7/1898 MacKay
1,146,934 A 7/1915 Gleeson
1,498,303 A 6/1924 Scherer et al.
1,627,469 A 5/1927 Syptroth
3,000,384 A 9/1961 Piers, Jr.
3,081,781 A * 3/1963 Stermer ..... A45D 8/34 132/273

(Continued)

FOREIGN PATENT DOCUMENTS

DE 202013104423 U1 1/2014
EP 0704178 A1 4/1996
JP 3217721 U 8/2018

OTHER PUBLICATIONS

United States Patent and Trademark Office, "International Search Report", dated May 13, 2020, International Application No. PCT/US20/22917.

*Primary Examiner* — Rachel R Steitz
(74) *Attorney, Agent, or Firm* — Bretton L. Crockett; TechLaw Ventures, PLLC

(57) ABSTRACT

Apparatus, systems and methods related to hair ties. In a first illustrative embodiment, a securing apparatus, such as a hair tie, has a middle section formed as an elongated pliable member. At a first end, a fastener body is attached to the elongated pliable member. At a second end, two connection loops may be disposed. In use, the fastener body may be passed through one of the two connection loops to configure the pliable member as a relatively large loop. This relatively large loop may be tightened, by drawing the pliable member further through the loop, until it is drawn tight on material to be retained therein. The pliable member may then be wrapped around the retained material until secured with the fastener body adjacent the connection loops. The fastener body may then be passed through the second connection loop to be retained therein.

12 Claims, 5 Drawing Sheets

(56) References Cited

U.S. PATENT DOCUMENTS 3,301,266 A 1/1967 Hoffman
4,042,241 A 8/1977 Collins
5,167,245 A 12/1992 Harriett
5,497,795 A 3/1996 Hibbard
5,499,638 A 3/1996 Ripley
5,577,299 A * 11/1996 Thompson ..... F16G 11/14 24/115 K
5,778,904 A 7/1998 Elsner
5,878,756 A 3/1999 Bilodeau
5,890,494 A 4/1999 Sonstegard
5,957,141 A 9/1999 Elkins
6,076,532 A 6/2000 Thomas et al.
6,182,672 B1 2/2001 Abasta-Douglas et al.
6,213,130 B1 4/2001 Alessandrino
6,293,285 B1 9/2001 Schach
6,601,589 B2 8/2003 Ericks
7,174,901 B2 2/2007 Haar et al.
7,222,630 B2 5/2007 Silva
9,204,700 B1 12/2015 Hsu
2005/0039310 A1* 2/2005 Borne ..... H02G 11/00 24/300
2005/0194018 A1 9/2005 Sonstegard et al.
2006/0081003 A1* 4/2006 MacHock ..... A44C 7/009 63/35
2007/0246059 A1 10/2007 Jensen
2008/0072922 A1* 3/2008 Shidler ..... A45D 8/34 132/275
2010/0162775 A1 7/2010 Martinez
2013/0014351 A1 1/2013 Kuglen et al.
2014/0083444 A1 3/2014 Grimm
2014/0283869 A1 9/2014 Sonstegard et al.
2015/0164196 A1 6/2015 Teboul et al.
2015/0282584 A1 10/2015 Boss
2015/0327649 A1 11/2015 Sze
2016/0100666 A1 4/2016 Martineck
2016/0157578 A1 6/2016 Ricci et al.
2016/0220003 A1* 8/2016 Hu ..... A45D 8/34
2016/0360849 A1 12/2016 Halstead
2018/0020799 A1 1/2018 Harris
2018/0271248 A1 9/2018 Steyaert

* cited by examiner

DOUBLE LOOP WRAPPING HAIR TIES

CROSS-REFERENCE TO RELATED APPLICATION

This application claims the benefit of U.S. Provisional Application No. 62/823,058, filed Mar. 25, 2019, which is incorporated herein by reference in its entirety, including but not limited to those portions that specifically appear hereinafter.

TECHNICAL FIELD

The present disclosure relates to apparatus, systems and methods for hair ties, especially elastic hair ties.

BACKGROUND

Typical hair ties for holding a bundle of a user's hair in a desired conformation, such as a ponytail, are single elastic loops that are repeatedly twisted around the bundled hair. In use, a user must repeatedly pass at least a portion of the bundle through the loop each time it is twisted, which requires manipulation by both hands and can be awkward. Rigid clips that lock into place around the bundle of hair can avoid this repeated insertion but lack the resilience of an elastic loop and are not suitable for many uses.

A hair tie made from a pliable material that was easier to use, inexpensive and attractive would be an improvement in the art.

SUMMARY

The present disclosure includes apparatus, systems and methods related to hair ties. In a first illustrative embodiment, a securing apparatus, such as a hair tie, has a middle section formed as an elongated pliable member, such as a cord or ribbon. At a first end, a fastener body is attached to the elongated pliable member. The fastener body is larger than the width of the pliable member and may have a larger diameter at a midpoint with relatively narrower ends on an axis orthogonal to the pliable member. At a second end, two connection loops may be disposed. The two connection loops may be joined at a midpoint to which the pliable member is attached and may be formed from the same material as the pliable member.

In use, the fastener body may be passed through one of the two connection loops to configure the pliable member as a relatively large loop. This relatively large loop may be tightened, by drawing the pliable member further through the loop, until it is drawn tight on material to be retained therein, such as a bundle of hair. The pliable member may then be wrapped around the material to be retained therein, until the material is secured, and the fastener body is adjacent the connection loops. The fastener body may then be passed through the second connection loop to be retained therein, with the material secured by the tie.

DESCRIPTION OF THE DRAWINGS

It will be appreciated by those of ordinary skill in the art that the various drawings are for illustrative purposes only. The nature of the present disclosure, as well as other embodiments of the present invention, may be more clearly understood by reference to the following detailed description, to the appended claims, and to the several drawings.

DETAILED DESCRIPTION

The present disclosure relates to apparatus, systems and methods for tie downs and fasteners, especially fasteners for hairstyles. It will be appreciated by those skilled in the art that the embodiments herein described, while illustrating certain embodiments, are not intended to so limit the disclosure or the scope of the invention. Those skilled in the art will also understand that various combinations or modifications of the embodiments presented herein can be made without departing from the scope of this disclosure. All such alternate embodiments are within the scope of the present invention.

Figure 1A:
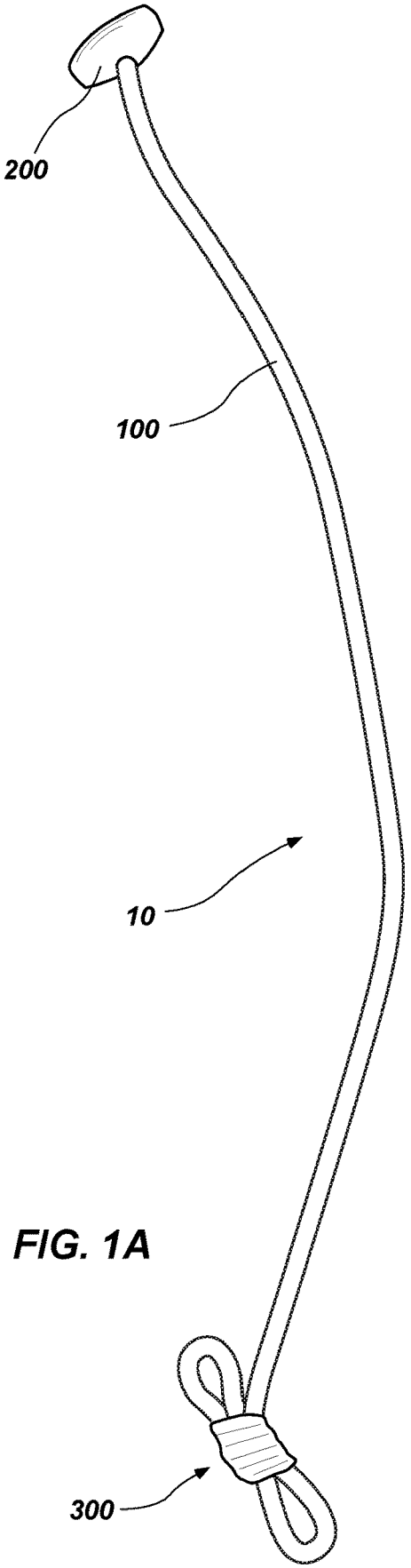
FIG. 1A is a top side view of a first embodiment of a wrapping tie in accordance with the principles of the present disclosure.
Figure 1B:
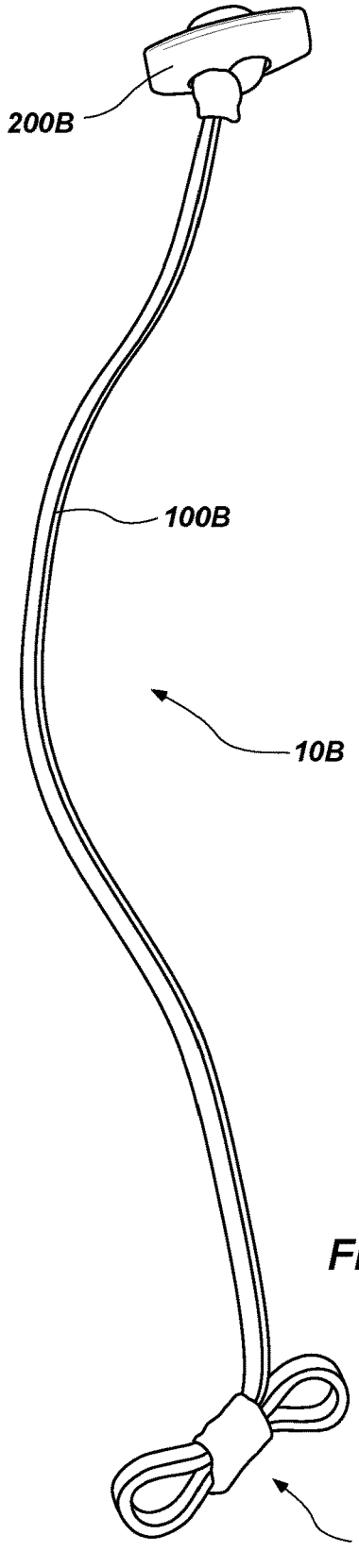
FIG. 1B is a top side view of a second embodiment of a wrapping tie in accordance with the principles of the present disclosure.

Referring to FIG. 1A, a first embodiment of a securing apparatus or wrapping tie 10 is depicted. Wrapping tie 10 has an elongated middle section formed as an elongated pliable member 100. In the depicted embodiment, the elongated pliable member 100 may be a cord with a circular cross-sectional shape, as depicted. It will be appreciated that other embodiments, where the elongated pliable member 100 has a different conformation may be used. For example, cords having an oval or polygonal cross-section. For example, the embodiment depicted in FIG. 1B, the elongated pliable member 100B is formed as a ribbon having two generally planar opposing sides.

It will be appreciated that for some embodiments the elongated pliable members 100, 100B may have elastic properties, similar to the elastic cording used for single loop hair ties. This can provide additional securing for certain applications. It will be further appreciated that the elongated pliable members may be of layered construction, with an outer surface that is relatively smooth to avoid snagging on material to be secured, such as a bundle of hair, and an inner core that provides elasticity and/or strength to the member. For example, an elastic cord that is covered by a relatively smooth textile material could be used.

Figure 2:
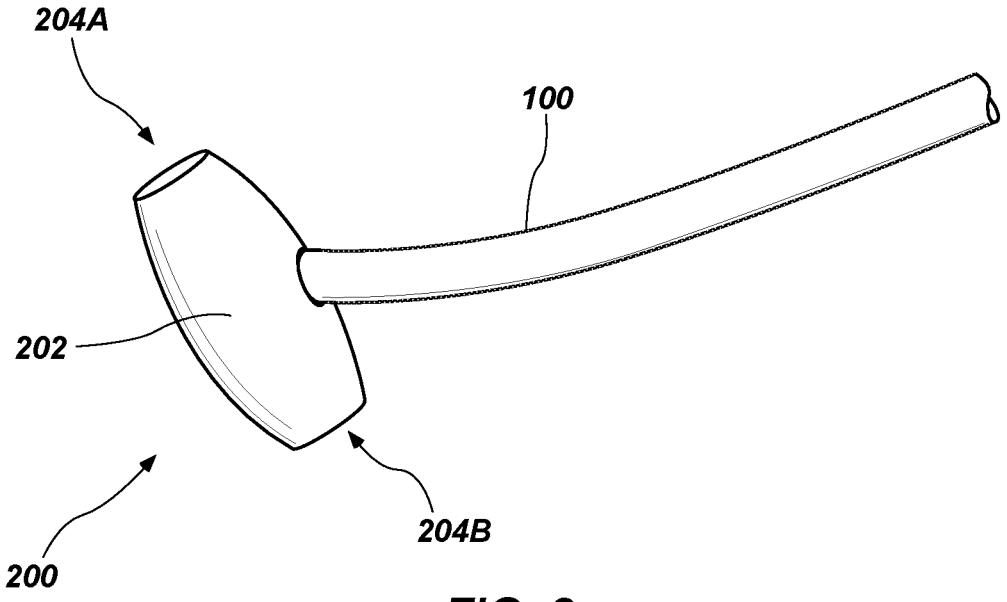
FIG. 2 is an enlarged view of the fastener body of the wrapping tie of FIG. 1A.

Referring to again to FIG. 1A, a fastener body 200 may be attached to the elongated pliable member 100. The fastener body 200 and its attachment are depicted in more detail in FIG. 2. As depicted, the fastener body 200 is larger than the width of the pliable member 100. In the depicted embodiment, the fastener member 200, may be formed as a body that is generally symmetrical from a larger diameter at a midline portion 202, tapering to two opposite ends 204A and 204B on an axis that is generally orthogonal to the pliable member 100. This can facilitate installation and use of the tie 10 for a user, as discussed further herein. It will be appreciated, that the different shapes for the fastener 200 may be used and are within the scope of the present disclosure. For example, shapes that are decorative or fasteners that lack the taper may be used.

In the depicted embodiment, the fastener body 200 is formed from a rigid material, and the end of the pliable member 100 is inserted into a bore 205 accessible thereon and retained therein, as by a suitable adhesive. It will be appreciated that this is merely illustrative and other connection structures and approaches may be used. For example, the faster could be clamped on the pliable member, or where formed from a polymeric material, could be directly molded thereon. In another example, the embodiment of FIG. 1B, the fastener 200B has two bores formed therethrough, with the pliable member 100B is drawn running through both bores and fastened to itself to retain the fastener 200B.

Figure 3A:
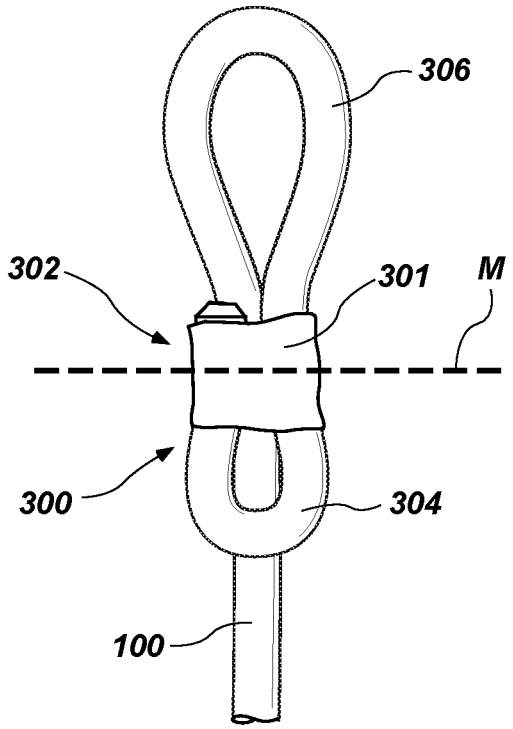
FIGS. 3A and 3B are front and rear enlarged views of a connection loop end of embodiment of a wrapping tie in accordance with the principles of the present disclosure.
Figure 3B:
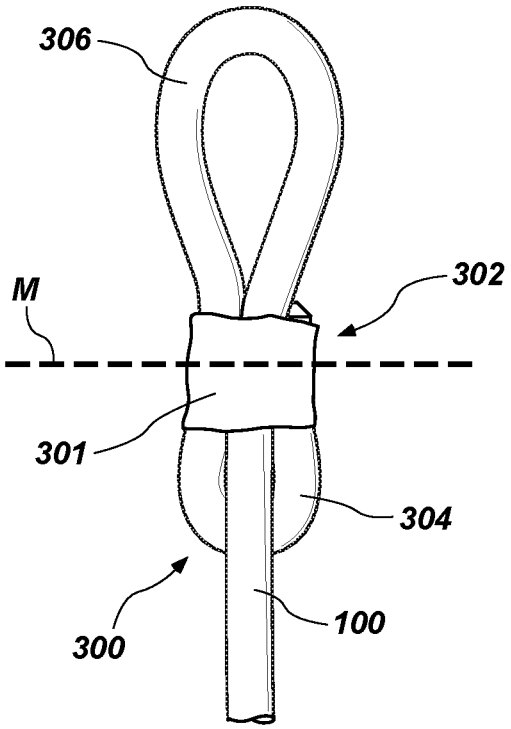

One illustrative embodiment of a second end of securing tie 10 is depicted in more detail in FIGS. 3A and 3B. As depicted, two connection loops are disposed at the second end, generally designated at 300. A first connection loop 304 and a second connection loop 306, may extend from a central body 302. In the depicted embodiment, the loops 304 and 306 may be formed by positioning the pliable member 100 in a desired conformation to form the connection loops and then securing them with a specialized fastener 301 which forms a portion of the central body 302 as it secures the pliable member defining the loops 304 and 306 in the desired conformation.

It will be appreciated that in other embodiments, the loops 304 and 306 may be formed by positioning the pliable member 100 in a desired conformation to form these structures and then securing them in another manner, as by wrapping with a cord (as depicted in the embodiment of FIG. 1) or using another suitable fastener that may form a portion of the central body 302. It will be further appreciated that the body and loops may be formed on a separate structure that is attached to the second end of the pliable member 100.

As depicted, the two connection loops 304 and 306 may be joined at a midpoint to form a generally FIG. 8 shape from the central body 302 to which the pliable member 100 is attached. It will be appreciated that other conformations may be used as well. As shown in the depicted embodiment, in some embodiments, the pliable member 100 may be attached to the midpoint such that it extends in a direction other than generally orthogonal to an axis defined by the joining of the loops 304 and 306 in a common plane.

As shown in the depicted embodiment, in some embodiments, the pliable member 100 may be attached to the midpoint such that it extends in a direction other than parallel to a midline M defined by the joining of the loops 304 and 306 in a common plane. In the depicted embodiment, the elongate pliable member 100 extends away from the body 302 on the same side of the midline axis M as the first connection loop 304. In the depicted the elongate pliable member 100 member extends generally orthogonally to the midline M of the body 302, generally parallel to a long axis of the first connection loop 304. It will be appreciated that the depicted angle is not the only angle that can be used, but that having the pliable member extending in a direction closer to the first loop may be advantageous for some uses, as described further herein.

The connection loops 304 and 306 may be formed from the same material as the pliable member 100. At least second loop 306 should be formed of an elastic material. As depicted, the second loop 306 may be slightly larger than the first loop 304. In other embodiments, the loops may be of equal size or second loop 306 may be slightly smaller than first loop 304. At least second loop 306, and preferably both loops, should be sized to allow the width of the pliable member 100, but not the long axis of the fastener 200 to pass therethrough in an unstretched conformation.

It is noted that for the depicted embodiments of ties 10 and 10B (FIG. 1B), that the connection loops may be as a continuation of the elongated pliable member 100 formed which is folded into the appropriate shape and maintained by the body 302. The elongated pliable member may exit the body 302 parallel to the first connection loop 304, as by exiting a common opening in a rigid body, or by being held parallel in a tied fashion.

It will be appreciated that the size of particular embodiments of securing ties in accordance with the present disclosure may vary based on the planned use of the particular tie. For use as ponytail holding hair styling ties embodiments similar to those depicted at 100 and 100B may have pliable elongated members 100 formed from elastic cording with a length from about 6 to about 10 inches in an unstretched condition and about 10 to 20 inches in a fully stretched condition, with one particular embodiment having a length from about 7.5 to about 8.5 inches in an unstretched condition and about 12 to 15 inches in a fully stretched condition. It will be further appreciated that in some embodiments, the either the entire tie 10 or 10B, or the connection end 300 and pliable member 100, could be formed as a unitary member molded from a suitable material, such as a silicone material having sufficient elasticity to serve as pliable member 100 and the connection loops 304 and 306. In such embodiments, the fastener body 200 could be molded of the same material or could be a separately attached rigid member.

Turning to FIGS. 4 through 7, one illustrative method of using the securing tie 10 of FIG. 1A is depicted.

Figure 4:
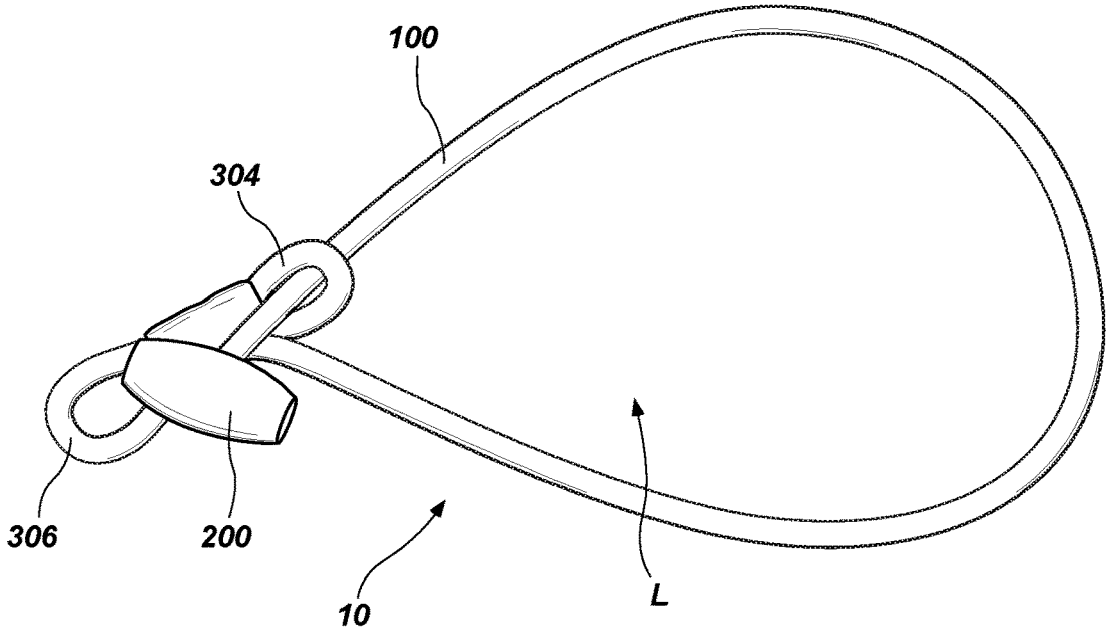
FIGS. 4, 5, 6A, and 7 depict one illustrative use for the wrapping tie of FIG. 1A.
Figure 5:
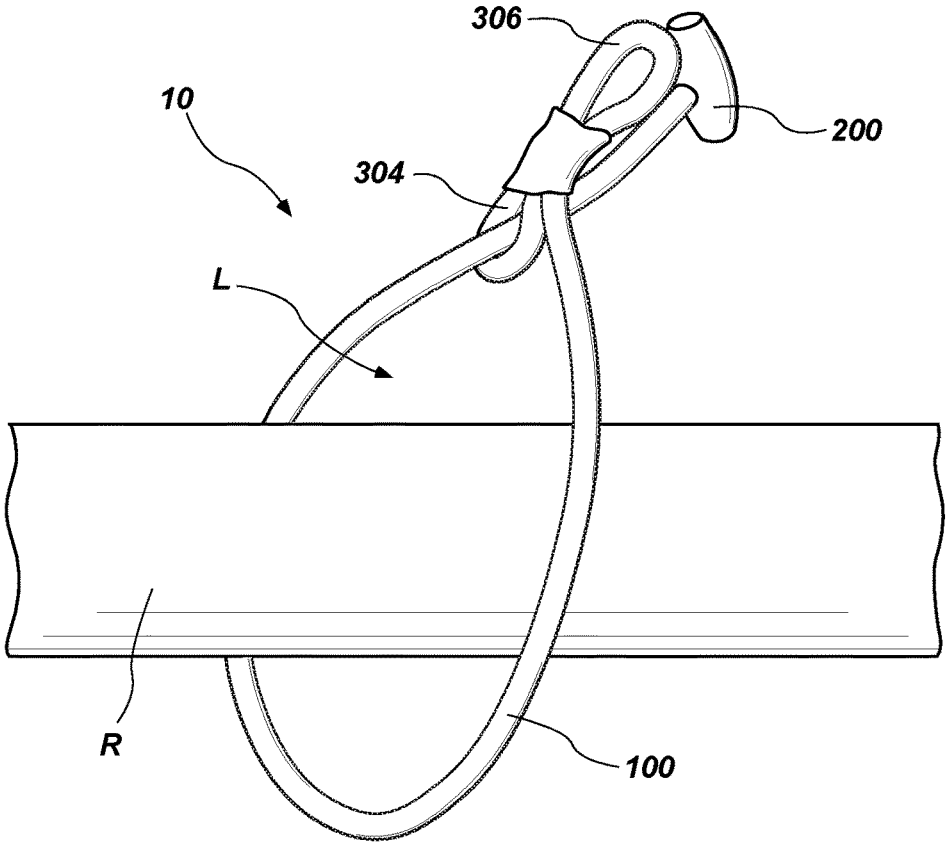

As depicted in FIGS. 4 and 5, the fastener body 200 is passed through one of the two connection loops, in this case first connection loop 304, to configure the pliable member 100 as a relatively large securing loop generally indicated at L. Optionally this can be performed in isolation as depicted in FIG. 4, and then the material to be secured can be inserted into the securing loop L. Alternatively, a user can encircle the material to the secured with the pliable member before passing the fastener body 200 through the connection loop, such that securing loop L is created around the material to be secured. The creation of securing loop L may be performed at the discretion of the user, or in a way that is best suited for the particular application. In either case, the end result will be the position of the material to be secured is within the securing loop L, as depicted in FIG. 5. For clarity of illustration, the material to be secured depicted in FIGS. 5, 6, and 7 is represented by a rod R. It will be appreciated that this is merely illustrative and the tie 10 may be used to secure any suitable material. For use as a hair tie, the material to be secured may be a bundle of hair, such as strands of hair drawn to together to form a ponytail, or hair with other materials such as decorative ribbons or the like, or hair extension materials.

As best depicted in FIGS. 4 and 5, in embodiments where the elongated pliable member extends away from the body 302 on the same side of the axis as the first connection loop 304, the second connection loop 306 will extend away from the securing loop L.

Once the relatively large securing loop L and tie 10 are in the desired position on the material to be secured, the securing loop L may be tightened on the material, by drawing the pliable member 100 further through the connection loop user may vary the level of the constriction of the member 100 on the material to be secured as desired. For example, where the tie 100 is used to secure cabling for electronic devices, it may be pulled quite taut for securing. For other uses, such as certain hairstyles, the level of constriction may be varied for user comfort or for different hairstyles.

Figure 6A:
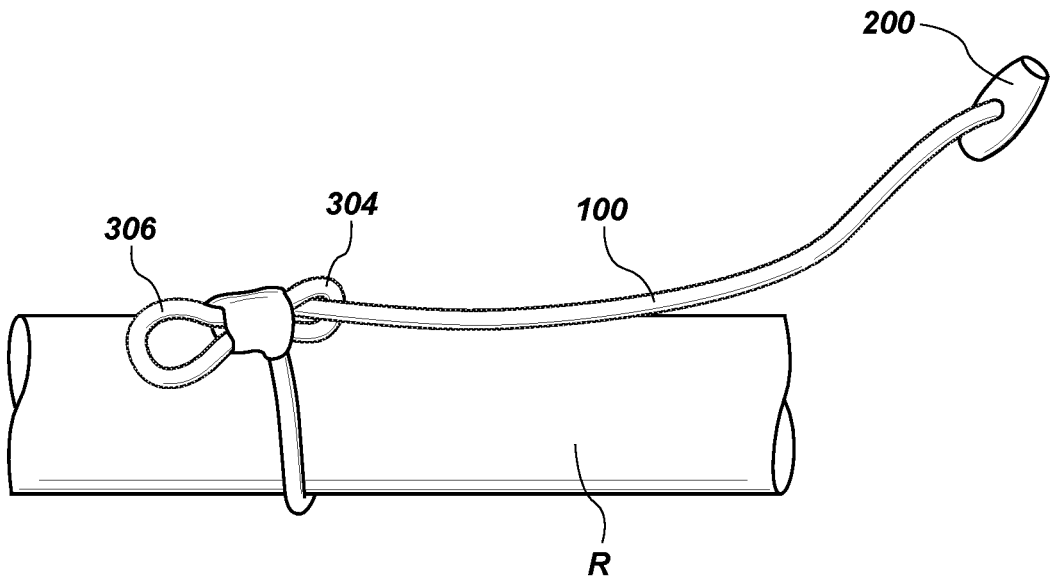
Figure 6B:
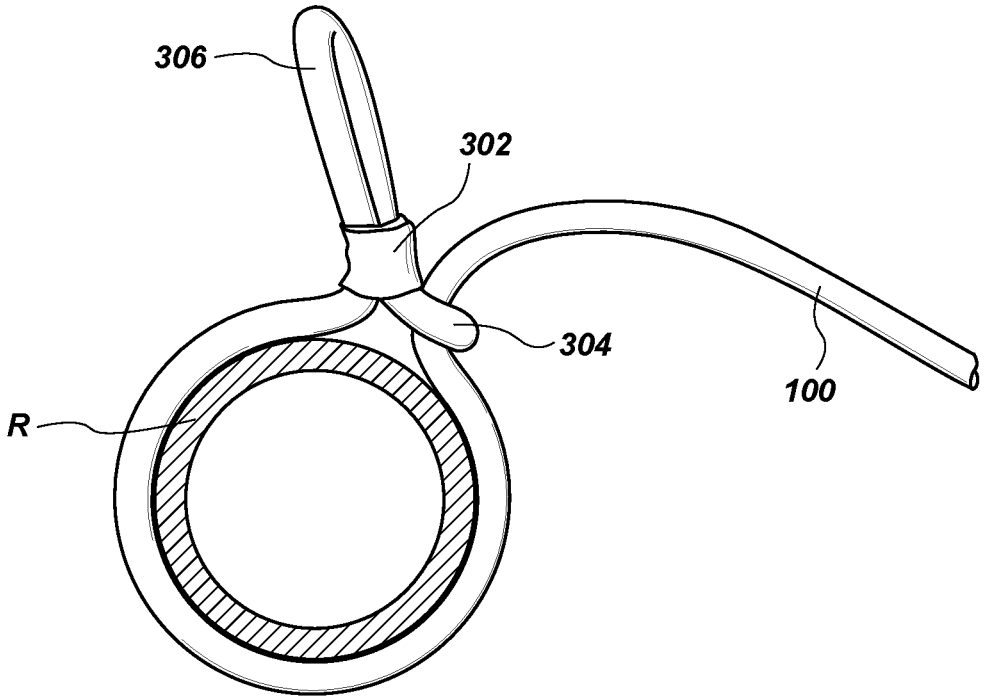
FIG. 6B depicts the connection loop end of FIGS. 3A and 3B during securing use.
Figure 7:
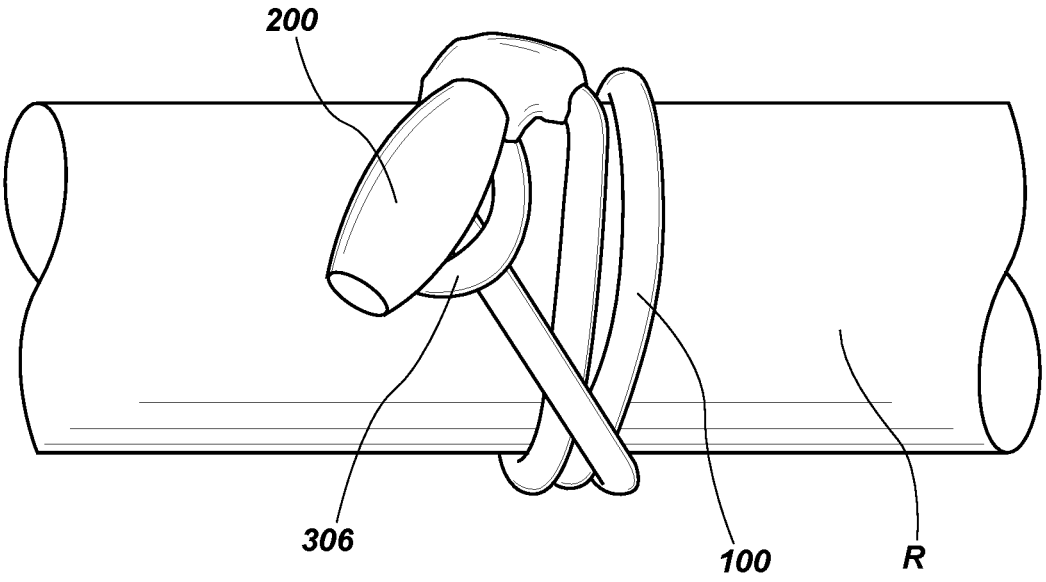

As best depicted in FIG. 6A, in embodiments where the elongated pliable member extends away from the body 302 on the same side of the midline axis as the first connection loop 304 and generally parallel to a long axis of the first connection loop 304, this will cause the second connection loop 306 to extend away from the securing loop L and the material to be fasted, such as rod R, in a generally perpendicular direction. This can be advantageous as it allows a user to easily locate the second loop 306 without difficulty and prevent the second loop 306 from laying sideways or flat with the material being wrapped. Where the material to be secured is a bundle of hair, this can help prevent the second loop 306 from being covered with the elongated member as it is wrapped around the bundle of hair.

The portion of the pliable member 100 drawn through the connection loop 304 may then be wrapped around the material to be retained therein, until the material is secured and the fastener body 200 is adjacent the connection loops 304 and 306. The fastener body 200 may then be passed through the second connection loop 306 to be retained therein. The material is then secured by the tie 10. It will be appreciated that the user may vary the level of the constriction of the member 100 on the material to be secured as desired by the tightness of the wrapping. For example, where the tie 100 is used to secure cabling for electronic devices, it may be wrapped very tightly for securing. For other uses, such as certain hairstyles, the level of constriction may be varied for user comfort or for different hairstyles.

The fastener body 200 may be passed through the connection loops 304 and 306 by alignment of the long axis of the fastener body 200 with the loop opening and insertion therethrough. Upon movement of the long axis of the fastener body away from alignment with the loop opening, the fastener is prevented from passing back through the loop. In some embodiments, the elastic nature of the connection loop material may allow it to be stretched over the fastener body 200 and return to the unstretched position and prevented from passing back through the loop. It will be appreciated that embodiments which utilize both these insertion and retention schema may be used.

It will be appreciated that the tie 10 may be secured by simply passing the fastener body 200 through one or both connection loops 304 and/or 306 to use the larger securing loop L at its maximum size. This may be desirable for certain hairstyles need a "loosely" held bunch of hair, as for a "loose" ponytail securing for workouts or sleeping. It will further be appreciated that with the fastener body 200 passed through one or both connection loops 304 and/or 306 to form the larger securing loop L at its maximum size, that the tie 10 could be used in the same repeated twisting fashion as a standard hair elastic. These multiple methods of use for a single fastener may be an additional improvement in the art.

While this disclosure has been described using certain embodiments, the present disclosure can be further modified while keeping within its spirit and scope. This application is therefore intended to cover any variations, uses, or adaptations of the disclosure using its general principles. Further, this application is intended to cover such departures from the present disclosure as come within known or customary practices in the art to which this invention pertains and which fall within the limits of the appended claims.

The invention claimed is:

1. A double loop wrapping hair tie securing apparatus, comprising:

an elongated pliable member;

a fastener body attached at a first end of the elongated pliable member, the fastener body being generally symmetrical and having a central portion with a width larger than a width of the pliable member and tapering to narrower end portions; and two connection loops disposed at a second end of the elongated pliable member, the two connection loops attached to and extending from a central body to which the elongated pliable member is attached to form a generally figure eight shape, wherein the each of the two connection loops is sized to allow the width of the pliable member, but not the portion of the fastener body with a width larger than the width of the pliable member to pass therethrough in an unstretched conformation.

2. The securing apparatus of claim 1, wherein the two connection loops are formed from an elastic pliable member.

3. The securing apparatus of claim 2, wherein the two connection loops are formed from a section of the elongated pliable member which has been positioned in the figure eight conformation and then secured together.

4. The securing apparatus of claim 1, wherein the elongated pliable member is an elastic pliable material and the two connection loops are and central body are formed, at least in part by a knot formed in the elongated pliable member.

5. The securing apparatus of claim 1, wherein the central body further comprises a fastener that secures the pliable member to itself to define a first connection loop and a second connection loop, each extending from the central body.

6. The securing apparatus of claim 5, wherein the first connection loop is smaller than the second connection loop.

7. The securing apparatus of claim 5, wherein the elongated pliable member extends from the central body in a direction other than generally parallel to a midline axis defined by the joining of the first connection loop and second connection loop in a common plane.

8. The securing apparatus of claim 7, wherein the elongated pliable member extends from the central body in a direction generally parallel to the first connection loop.

9. The securing apparatus of claim 5, wherein the fastener comprises a clip that secures folded portions of the elongated pliable member to define the two connection loops.

10. The securing apparatus of claim 1, wherein the elongated pliable member is formed from a rounded cord or a flat cord.

11. The securing apparatus of claim 1, wherein the fastener body central portion has a larger diameter midpoint and tapers to the narrower ends on an axis orthogonal to the axis of attachment to the pliable member.

12. The securing apparatus of claim 1, wherein the fastener body includes a central bore extending through the central body which is accessible at opposite openings disposed at the narrower ends.

* * * * *